United States Patent [19]

Erödi et al.

[11] 4,043,170

[45] Aug. 23, 1977

[54] PATENTING PROCESS AND APPARATUS COMBINED WITH A WIRE

[75] Inventors: György Erödi; István Gorondi; László Kovács; György Takács, all of Miskolc, Hungary

[73] Assignee: "December 4" Drótmüvek, Miskolc, Hungary

[21] Appl. No.: 659,353

[22] Filed: Feb. 19, 1976

[30] Foreign Application Priority Data

Feb. 20, 1975 Hungary ..... DE 881

[51] Int. Cl.[2] ..... B21D 31/00; B21D 37/16

[52] U.S. Cl. ..... 72/364; 72/378; 148/12 B

[58] Field of Search ..... 72/46, 200, 202, 364, 72/274, 278, 286, 289, 342, 378; 148/12 B, 153–157; 266/104, 107

[56] References Cited

U.S. PATENT DOCUMENTS

| | | | |
|---|---|---|---|
| 2,231,009 | 2/1941 | Holt | 148/15 |
| 2,965,368 | 12/1960 | McIlvried | 148/156 X |
| 3,557,336 | 1/1971 | Bullough et al. | 148/154 X |
| 3,580,746 | 5/1971 | Behar | 148/12 B |

*Primary Examiner*—E. M. Combs

*Attorney, Agent, or Firm*—Karl F. Ross; Herbert Dubno

[57] ABSTRACT

A patenting process and a hot-forming process take place simultaneously, based on the principle of the direct electrical resistance heating, in an apparatus wherein the steel wire is led onto two discs or drums, provided with peripheral surfaces having different diameters and immersed in the patenting medium and from here the wire is led onto a guide disc or drums, outside the patenting medium.

2 Claims, 4 Drawing Figures

PATENTING PROCESS AND APPARATUS COMBINED WITH A WIRE

The invention relates to a patenting process and to a hot-forming process taking place simultaneously, based on the principle of the direct electrical resistance heating. The invention relates also to an apparatus for carrying out the process according to the invention and wherein the steel wire is passed over two drums whose peripheral surfaces have different diameters and are immersed in the patenting medium and from which the wire is led onto a guide drum outside the patenting medium.

In dependence of the number of turns of the wire on the immersing drum surface having a greater diameter, the residence time in the patent-in medium can be easily controlled; this permits operation with the usual speed of wire drawers which have not been used hitherto for this purpose, since these machines have been considered as oversized for patenting processes. Also, it makes it possible to unite these two basic process steps, the combination, not having been possible heretofore.

It is a well known fact that steel wire is hardening after cold forming to a certain extent, thereby making further transformation practically impossible. Nevertheless, if a further transformation is imperative, for example reduction of the diameter is wanted, the wire is subjected to a heat treatment (patenting), enabling further transformation.

The processes mentioned above are performed separately. Although it has been theoretically possible to unit these processes, a combination of the operations is hindered in practice partly by the apparatus presently used and, partly by the transit speed considered to be economical.

A further factor impeding the combination of the operations is that, while the wire drawers presently used work with a single wire, patenting equipment usually is operated with several, generally with 10–30 wires, passing simultaneously into the patenting medium, thus achieving a higher efficiency.

If the systems currently in use were to be coupled to each other (assuming that the problem of "one wire - several wires" has also been solved, a reasonable assumption at the present level of knowledge) the problems are as follows:

a. matching the speed of the wire drawers, which are several orders of magnitude higher, to the usual speed of the patenting furnaces results in an operation with rather unfavorable speed conditions at the wire drawer; and b. matching the speed of the patenting furnace, usually several orders of magnitude lower, to the customary speed of the wire drawers creates problems because of the residence time in the patenting furnace which thereby depends upon the base material of the wire, requiring oversized dimensions of the equipment needed for heat treatment.

The object of our invention is to eliminate the technical and economical disadvantages mentioned above.

SPECIFIC DESCRIPTION

Figure 1:
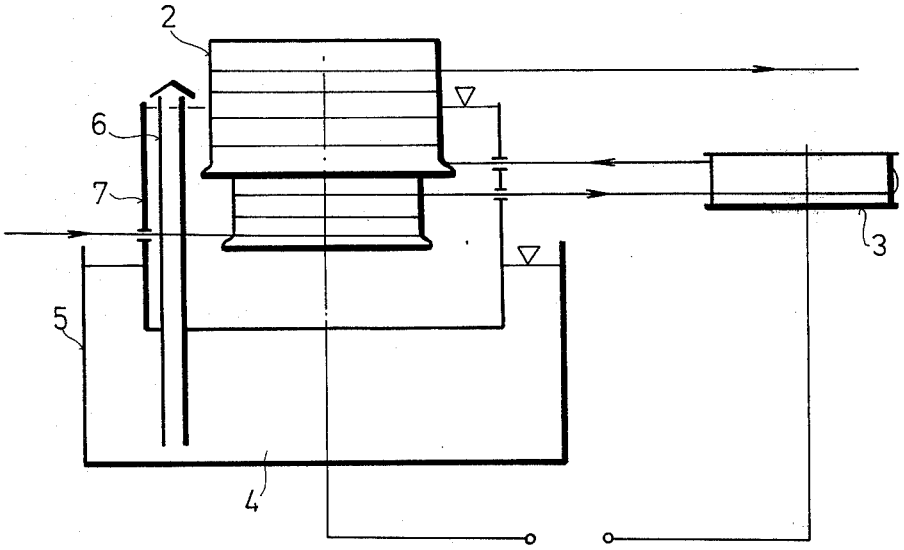
FIG. 1 shows the side view of the two-phase equipment.
Figure 2:
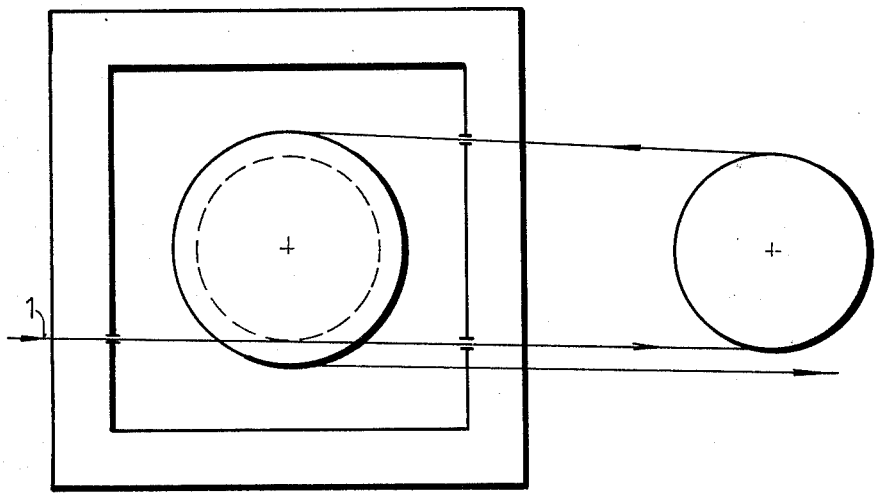
FIG. 2 is a top view of the apparatus illustrated in FIG. 1.

The steel wire arriving from the wire drawer is wound tangentially onto the cylindrical surface of smaller diameter $d_1$ of a freely rotating drum 2, provided with two drum parts with different diameters. After passing over several turns the wire is unwound and travels onto one or more guide drums 3, the axis of which is parallel to that of the drum 2. The wire then travels, after having made electrical contact with drum 3 and having changed its direction of advance backwards to the drum part having the greater diameter $d_2$ of the drum 2. The wire, contacting the drum tangentially, wound onto the cylindrical surface of the large-diameter part with a certain number of turns. The wire then unwinds and travels towards the surface shaping element 9 and the wire drawer. The number of turns on the drum part with the diameter $d_2$ is such that the residence time of the wire on the drum surfaces and in the patenting bath, respectively should always exceed the residence time needed for patenting.

The drums 2 and 3 are forming the poles of an electrical supply source applied voltage, the wire between the discs is under the the temperature of the wire heated to glowing and increases in the direction of advance. The double disc is immersed into the patenting medium, being a patenting salt, having good electrical conductivity and constituting an electrical contact at the same voltage to as drum 2. The bath is provided in the form of a double tank system. The lower tank 5 is heated from the exterior in a known manner and so that a temperature of the patenting medium (approx. 500° C) is applied. Simultaneously the lower tank serves as a buffer tank, the patenting medium being delivered by means of a pump 6, preferably a mammoth pump, into the upper tank 7.

The drum 2 is immersed in the patenting medium in the upper tank such that the wire wound onto the drum surface should be entirely covered by the patenting medium during operation. The upper flange of the upper tank lies above the height of the wire and is opened at the inlet and outlet at which the wire enters and leaves the system, respectively, to ensure the unhindered travel of the wire. The patenting medium delivered by the pump is returned to the buffer tank through these openings.

Taking into consideration that $D_2 \geqq d_1$ and that the wire, passed around the drum surfaces of different diameters, picks up the circumferential speed of the revelant drum part, the speed being naturally higher in case of the drum part having a greater diameter, the wire undergoes a stretch transformation process in the region between the two drums 2 and 3. It is a well known fact that the transformation takes place at a minimal value of transformation resistance of the wire, i.e. at the hottest spot, directly before the wire enters into the patenting bath, i.e. it coincides with the beginning of transformation.

The equipment can be designed — in accordance with the electrical supply — as a two-phase, three-phase or multiphase system.

Figure 3:
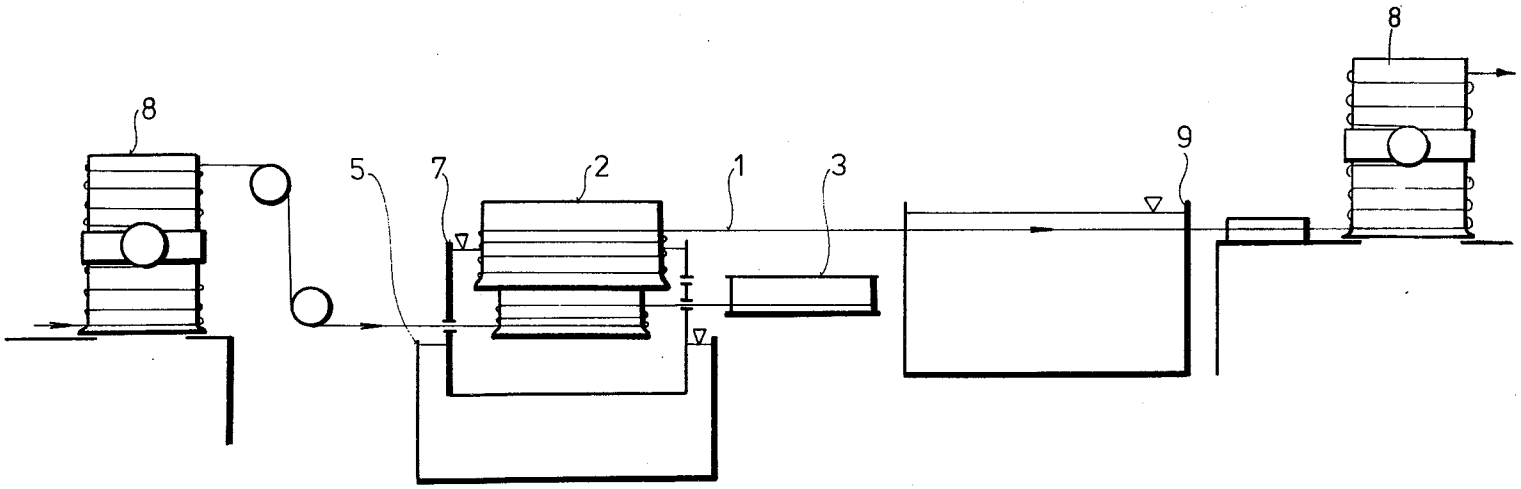
FIG. 3 shows the apparatus of the invention coupled to the wire drawer.

The two-phase apparatus — shown in FIG. 3 is coupled to the wire. It goes without saying that three-phase or multiphase apparatus can be coupled in the same manner; coupling may take place upstream or downstream of the wire drawer or between the machines. In the drawing the surface shaping element 9, known per se, taking part in the process, may be seen too.

It is obvious that when the equipment is installed after the wire drawer, the drum 2 is to be driven — in the known way — in accordance with the speed of the wire drawer; the drive in question is not necessarily required, when coupling takes place before or between the machines.

Theoretically the methods of matching described above can be applied to any type of wire drawer; nevertheless taking into consideration the fact that on a production line no circumstances can be permitted which the wire drawer ought not have been stopped during the operation of the patenting equipment, the methods can be applied with the machines of the Bacro type.

Evidently, the equipment can be operated as a single independent unit. In this case the double disc is to be driven in the usual way.

Figure 4:
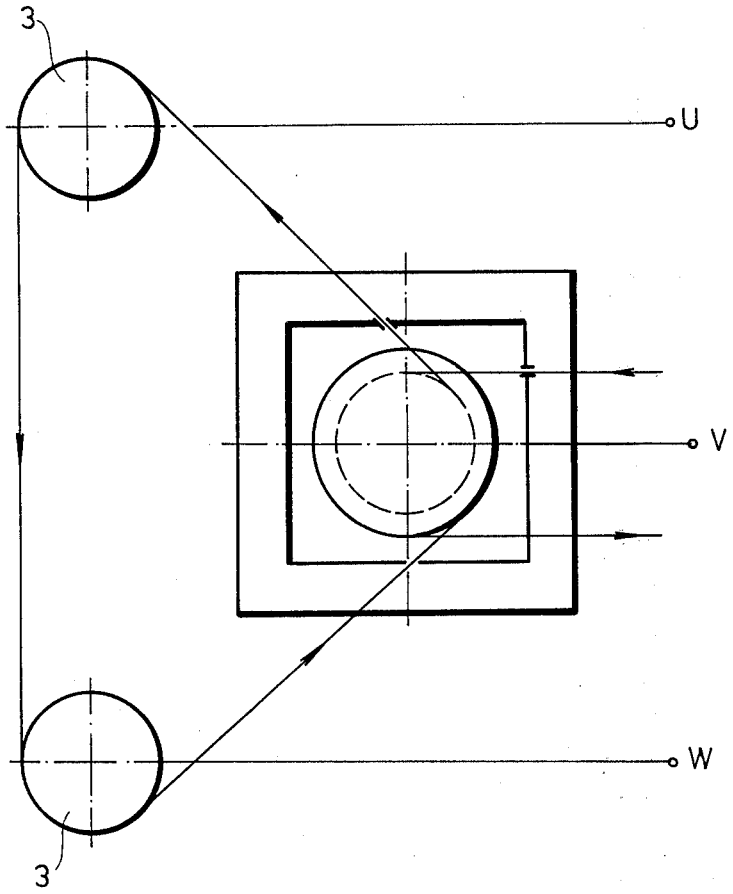
FIG. 4 shows a schematic arrangement of the three-phase equipment.

The embodiment of the three-phase equipment with the Δ-connection is illustrated in FIG. 4. A multiphase Δ-connection with several guide discs can be used; by the appropriate leading of the conducts and by adequate applying of the voltage, an Y-connection can be also established.

The advantages of the process according to the invention and the apparatus thereof are, as follows:

When producing steel wire, it is possible to combine the two basic operation, i.e. drawing of the wire and patenting, thus a production line can be achieved on which finished products made of rolled wire can be manufactured.

The invention solves the problem of electrical contact by a salt contact for the resistance heating, resulting in heating nearly free of scaling, while effecting a hot-forming process combined with heat treatment.

By using the collecting drum, small structural dimensions may be obtained, as a consequence of the identity of the pre-heating and patenting bath the possibility of a further simplification of the equipment is given.

The small structual dimensions, the simple construction require low investment and operating costs, simultaneously ensuring high productivity. Furthermore technical parameters, such as production per unit of surface area, the ratio of useful calories to the losses in calories etc. yield favorable values.

What we claim is:

1. A method of simultaneously patenting and hot-forming a metal wire comprising the steps of:

a. feeding said wire onto a small-diameter part of a stepped drum having a large-diameter cylindrical part and a small-diameter cylindrical part;

b. passing said wire around said small-diameter part in a plurality of turns;

c. leading said wire after it has passed in said plurality of turns around said small-diameter part around a guide drum spaced from said stepped drum;

d. passing said wire from said guide drum onto said large-diameter part;

e. passing said wire in a plurality of turns around said large-diameter part and thereafter leading said wire away from said stepped drum;

f. passing an electric current through the wire between said drums sufficient to heat said wire to a patenting and hot-forming temperature; and g. contacting said turns of wire on said stepped drum with a patenting bath.

2. An apparatus for the simultaneous patenting and hot-forming of metal wire, comprising:

a. a tank containing a patenting path;

b. a stepped drum having a large-diameter cylindrical part and a small-diameter cylindrical part rotatable about an axis and immersed in said bath;

c. means for feeding a wire to be patented and hot-formed onto the surface of said small-diameter part, said wire passing in a plurality of turns around said small-diameter part in contact with said bath;

d. a guide drum spaced from said stepped drum, said wire passing from said small-diameter part around said guide drum and returning to said large-diameter part and passing therearound in a plurality of turns in contact with said bath;

e. means for leading said wire away from said large-diameter part; and f. a source of electric current connected between said guide drum and the wire on said stepped drum for passing an electric current through the stretches of wire between said drums, thereby heating said wire to patenting and hot-forming temperature.

* * * * *

UNITED STATES PATENT AND TRADEMARK OFFICE

CERTIFICATE OF CORRECTION

PATENT NO. : 4 043 170

DATED : 23 August 1977

INVENTOR(S) : György ERDÖDI ET AL.

It is certified that error appears in the above-identified patent and that said Letters Patent are hereby corrected as shown below:

IN THE HEADING, line /75/, for the first inventor's last name"ERÖDI" read --ERDÖDI--.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*